US009239556B2

(12) United States Patent
Egi

(10) Patent No.: US 9,239,556 B2
(45) Date of Patent: Jan. 19, 2016

(54) FIXING DEVICE AND IMAGE FORMING APPARATUS

(71) Applicant: KYOCERA DOCUMENT SOLUTIONS INC., Osaka-shi, Osaka (JP)

(72) Inventor: Makoto Egi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 75 days.

(21) Appl. No.: 14/189,953

(22) Filed: Feb. 25, 2014

(65) Prior Publication Data

US 2014/0241767 A1 Aug. 28, 2014

(30) Foreign Application Priority Data

Feb. 28, 2013 (JP) ..... 2013-039713

(51) Int. Cl.
*G03G 15/20* (2006.01)

(52) U.S. Cl.
CPC .... *G03G 15/2053* (2013.01); *G03G 2215/2035* (2013.01)

(58) Field of Classification Search
None
See application file for complete search history.

(56) References Cited

U.S. PATENT DOCUMENTS

2010/0247183 A1 9/2010 Haseba et al.
2011/0182620 A1* 7/2011 Kawamichi ..... 399/123
2013/0195491 A1* 8/2013 Suzuki et al. ..... 399/69
2013/0209146 A1* 8/2013 Yamaji et al. ..... 399/329
2014/0241768 A1* 8/2014 Egi ..... G03G 15/2017 399/329
2014/0376934 A1* 12/2014 Egi ..... G03G 15/205 399/33
2014/0376935 A1* 12/2014 Egi ..... G03G 15/2053 399/33
2014/0376979 A1* 12/2014 Egi ..... G03G 15/2053 399/329

FOREIGN PATENT DOCUMENTS

JP 2001-147605 A 5/2001
JP 2005-249958 A 9/2005
JP 2007-025271 A 2/2007
JP 2009-288281 A 12/2009
JP 2010-231094 A 10/2010

OTHER PUBLICATIONS

An Office Action; "Notice of Reasons for Rejection," issued by the Japanese Patent Office on May 19, 2015, which corresponds to Japanese Patent Application No. 2013-039713.

* cited by examiner

*Primary Examiner* — David Gray
*Assistant Examiner* — Geoffrey Evans
(74) *Attorney, Agent, or Firm* — Studebaker & Brackett PC

(57) ABSTRACT

A fixing device includes a fixing belt, a pressuring rotator, a pressing member, a heat source, a supporting member, and an end cap. The fixing belt is rotatably provided. The pressuring rotator is rotatably provided, and comes into pressure contact with the fixing belt to form a fixing nip between the fixing belt and the pressuring rotator. The pressing member presses the fixing belt from inside toward the pressuring rotator. The heat source is disposed outside of the fixing belt, and heats the fixing belt. The supporting member faces the heat source across the fixing belt, and supports the fixing belt from inside. The end cap is mounted to an end part in the direction of a rotation axis of the fixing belt, and is rotatably supported by the supporting member.

16 Claims, 8 Drawing Sheets

FIXING DEVICE AND IMAGE FORMING APPARATUS

INCORPORATION BY REFERENCE

This application is based on and claims the benefit of priority from Japanese Patent application No. 2013-039713 filed on Feb. 28, 2013, the entire contents of which are incorporated herein by reference.

BACKGROUND

The present disclosure relates to a fixing device configured to fix a toner image on a recording medium and an image forming apparatus provided with the fixing device.

An electrographic image forming apparatus such as a printer or a copying machine forms a toner image on a surface of a recording medium such as a sheet, and subsequently, heats and pressures the recording medium and the toner image by a fixing device, thereby fixing the toner image on the recording medium.

As a manner of the above-mentioned fixing device, a manner of forming a fixing nip for heating and pressuring a recording medium and a toner image by a fixing roller and a pressuring roller is known. The above-mentioned fixing roller is formed by covering an outer circumferential face of a metallic cored bar with a resin having a high toner release property, for example. Also, as a heat source for heating the above-mentioned fixing roller, a halogen heater is used, for example. This halogen heater is disposed inside of the cored bar of the fixing roller, for example.

On the other hand, a manner (so called IH (Induction Heating) manner) of using an IH coil as a heat source instead of the halogen heater is known. The above-mentioned IH coil generates a magnetic field by way of electrification. Among fixing devices of such IH manner, there exists a fixing device forming the fixing nip by a fixing belt and a pressuring roller instead of forming the fixing nip by a fixing roller and a pressuring roller. The above-mentioned fixing belt is composed of a rotatable endless belt. In addition, an eddy current is generated at the fixing belt byway of action of the magnetic field generated by the IH coil.

Also, as a rotation manner of the fixing belt, a manner of rotating the fixing belt together with one or a plurality of rollers disposed inside of the fixing belt is known. On the other hand, a manner of disposing a pressing member inside of the fixing belt and sliding the fixing belt with respect to the pressing member is known as well.

In the fixing device of such a manner, the fixing belt is prone to deviate to the outside in the direction of a rotation axis of the fixing belt, and one of the important problems is to restrain such deviation of the fixing belt. For example, an end cap is mounted to an end part in the direction of the rotation axis of the fixing belt (hereinafter, simply referred to as an "end part of the fixing belt"), and by the end cap, deviation of a predetermined margin or more of the fixing belt is restrained. In a case where the deviation of the fixing belt is thus restrained by using the end cap, it is desirable to rotate the end cap together with the fixing belt in order to prevent lowering of durability of an end part of the fixing belt. In addition, in order to thus rotate the end cap together with the fixing belt, the end part of the fixing belt may be corrected in a circular shape by the end cap.

A problem in a case where the end part of the fixing belt is corrected in the circular shape by the end cap as mentioned above will be described with reference to FIG. 8A and FIG. 8B.

In the fixing device using the IH manner and the manner of sliding the fixing belt with respect to the pressing member, a positional relationship between an IH coil 71 and a fixing belt 72 greatly influences a heating performance of the fixing belt 72, and thus, it is desirable to enhance precision of position between the IH coil 71 and the fixing belt 72. However, in a case where an end part of the fixing belt 72 is corrected in a circular shape by an end cap 73, an outer diameter of the end part of the fixing belt 72 is greater than an outer diameter of a central part of the fixing belt 72, as shown in FIG. 8A. As a result, a distance d1 between the end part of the fixing belt 72 and the IH coil 71 is smaller than a distance d2 between the central part of the fixing belt 72 and the IH coil 71. Thus, it becomes difficult to normalize (uniform) the distance between the IH coil 71 and the fixing belt 72 all over the areas in the direction of the rotation axis of the fixing belt 72.

As a solution to such a problem, as shown in FIG. 8B, it is considered that a supporting member 74 is disposed at a position facing the IH coil 71 across the fixing belt 72, and by this supporting member 74, the fixing belt 72 is supported from inside. However, if such configuration is adopted, in a case where a relative positional relationship between the fixing belt 72 and the supporting member 74 is displaced, steps occur in the fixing belt 72 in peripheral regions of both end parts of the supporting member 74 (refer to the portion Y of FIG. 8B), a shear stress concentrates on the steps, and there is a concern about lowering of the durability of the fixing belt 72.

SUMMARY

In accordance with an embodiment of the present disclosure, a fixing device includes a fixing belt, a pressuring rotator, a pressing member, a heat source, a supporting member, and an end cap. The fixing belt is rotatably provided. The pressuring rotator is rotatably provided, and comes into pressure contact with the fixing belt to form a fixing nip between the fixing belt and the pressuring rotator. The pressing member presses the fixing belt from inside toward the pressuring rotator. The heat source is disposed outside of the fixing belt, and heats the fixing belt. The supporting member faces the heat source across the fixing belt, and supports the fixing belt from inside. The end cap is mounted to an end part in the direction of a rotation axis of the fixing belt, and is rotatably supported by the supporting member.

In accordance with an embodiment of the present disclosure, an image forming apparatus includes a fixing device. The fixing device includes a fixing belt, a pressuring rotator, a pressing member, a heat source, a supporting member, and an end cap. The fixing belt is rotatably provided. The pressuring rotator is rotatably provided, and comes into pressure contact with the fixing belt to form a fixing nip between the fixing belt and the pressuring rotator. The pressing member presses the fixing belt from inside toward the pressuring rotator. The heat source is disposed outside of the fixing belt, and heats the fixing belt. The supporting member faces the heat source across the fixing belt, and supports the fixing belt from inside. The end cap is mounted to an end part in the direction of a rotation axis of the fixing belt, and is rotatably supported by the supporting member.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

First Embodiment

Figure 1:
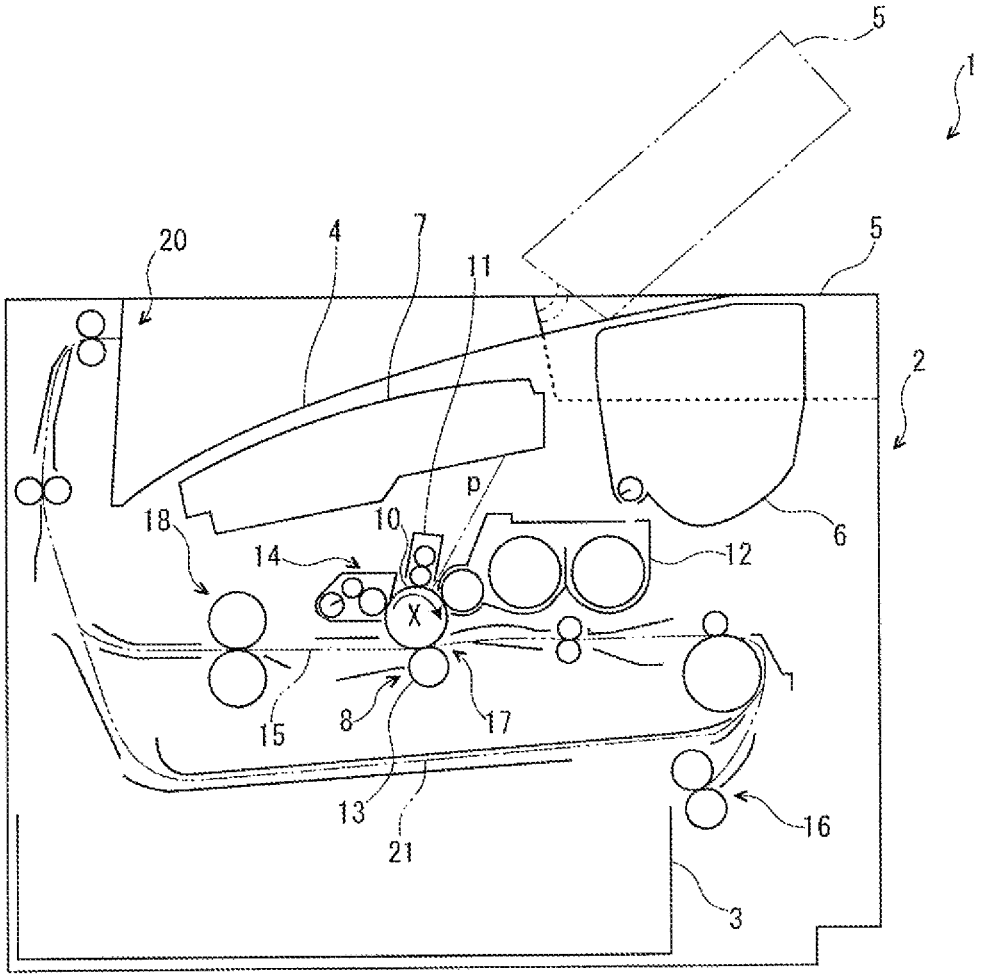
FIG. 1 is a schematic view showing an outline of a configuration of a printer according to a first embodiment of the present disclosure.

First, with reference to FIG. 1, the entire structure of a printer 1 (an image forming apparatus) will be described. FIG. 1 is a schematic view showing an outline of a configuration of a printer according to a first embodiment of the present disclosure.

The printer 1 includes a box-formed printer main body 2. In a lower part of the printer main body 2, a sheet feeding cartridge 3 storing sheets (recording medium) is provided and, on an upper surface of the printer main body 2, a sheet ejecting tray 4 is provided. On the upper surface of the printer main body 2, an upper cover 5 is provided openably and closably near the sheet ejecting tray 4. Below the upper cover 5, a toner container 6 is stored.

In an upper part of the printer main body 2, an exposure device 7 consisting of a laser scanning unit (LSU) is arranged below the sheet ejecting tray 4. Below the exposure device 7, an image forming unit 8 is provided. In the image forming unit 8, a photosensitive drum 10 as an image carrier is rotatably provided. Around the photosensitive drum 10, a charger 11, a developing device 12, a transferring roller 13 and a cleaning device 14 are arranged along the rotational direction of the photosensitive drum 10 (refer to an arrow X in FIG. 1).

In the printer main body 2, a sheet conveying path 15 is provided. At an upper stream end of the conveying path 15, a sheet feeder 16 is provided. At an intermediate stream part of the conveying path 15, a transferring unit 17 formed by the photosensitive drum 10 and the transferring roller 13 is provided. At a lower stream part of the conveying path 15, a fixing device 18 is provided. At a lower stream end of the conveying path 15, a sheet ejecting part 20 is provided. Below the conveying path 15, an inversion path 21 for duplex printing is formed.

Next, the operation of forming an image by the printer 1 having the above-mentioned configuration will be described.

When the power is supplied to the printer 1, various parameters are initialized and initial determination, such as temperature determination of the fixing device 18, is carried out. Subsequently, when image data is inputted and a printing start is directed from a computer or the like connected with the printer 1, the image forming operation is carried out as follows.

First, the surface of the photosensitive drum 10 is electrically charged by the charger 11. Then, the surface of the photosensitive drum 10 is exposed corresponding to the image data with a laser (refer to a two-dot line P in FIG. 1) from the exposure device 7, thereby forming an electrostatic latent image on the surface of the photosensitive drum 10. The electrostatic latent image is developed to a toner image with the toner (developer) by the development device 12.

On the other hand, a sheet fed from the sheet feeding cartridge 3 by the sheet feeder 16 is conveyed to the transferring unit 17 in a suitable timing for the above-mentioned image forming operation. Then, in the transferring unit 17, the toner image on the photosensitive drum 10 is transferred onto the sheet. The sheet with the transferred toner image is conveyed to a lower stream side on the conveying path 15 to enter the fixing device 18, and then, the toner image is fixed on the sheet in the fixing device 18. The sheet with the fixed toner image is ejected from the sheet ejecting part 20 on the sheet ejecting tray 4. The toner remained on the photosensitive drum 10 is collected by the cleaning device 14.

Next, a fixing device 18 will be described with reference to FIG. 2 and FIG. 3.

Hereinafter, for the sake of convenience of explanation, the left side of the sheet in FIG. 2 (the frontal side of the sheet in FIG. 3) corresponds to a front side (foreside) of the fixing device 18. Also, an arrow I of FIG. 2 indicates inside in a forward or backward direction, and an arrow O of FIG. 2 indicates outside in the forward or backward direction.

Figure 2:
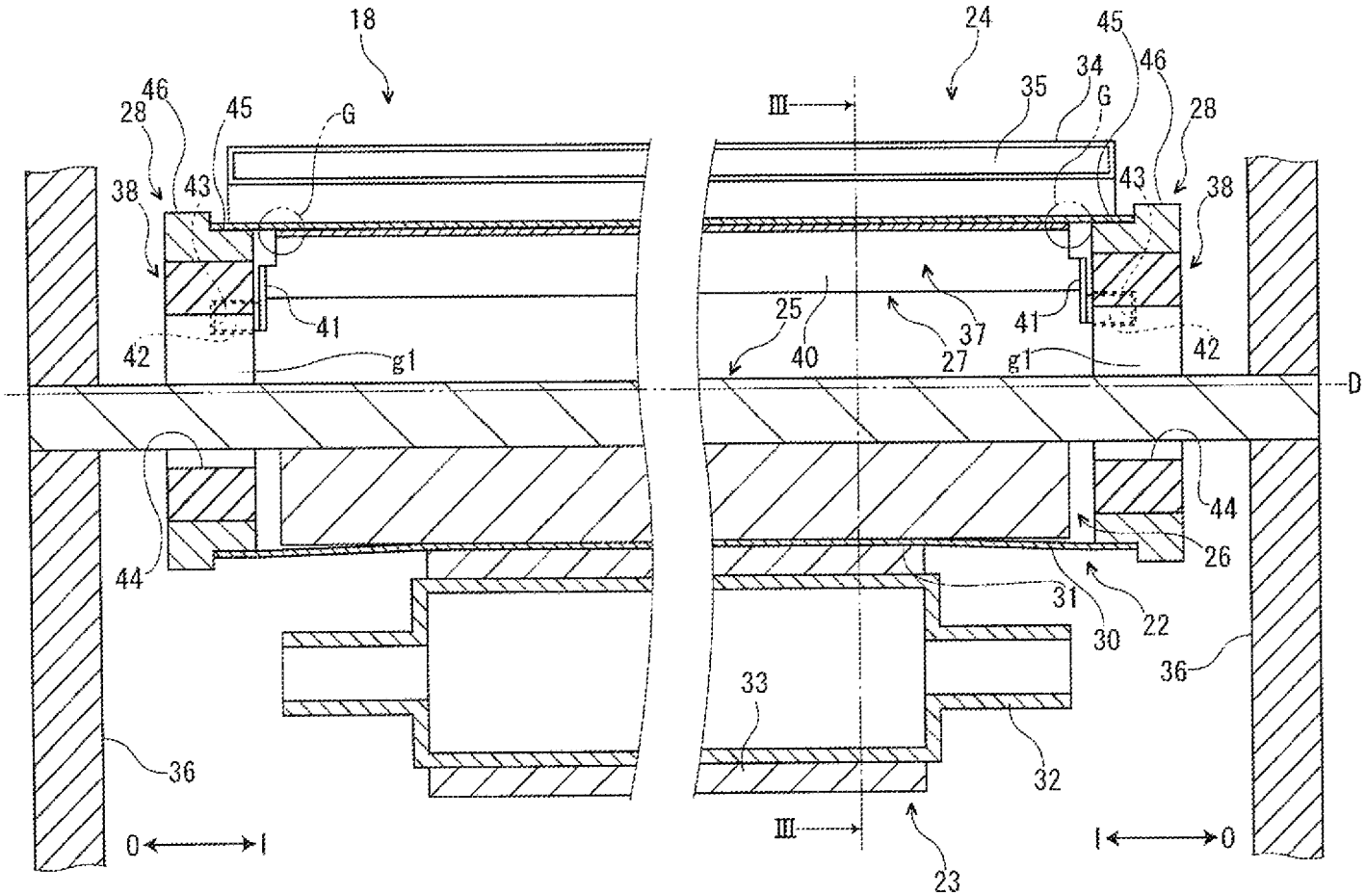
FIG. 2 is a sectional side view showing a fixing device in the printer according to the first embodiment of the present disclosure.
Figure 3:
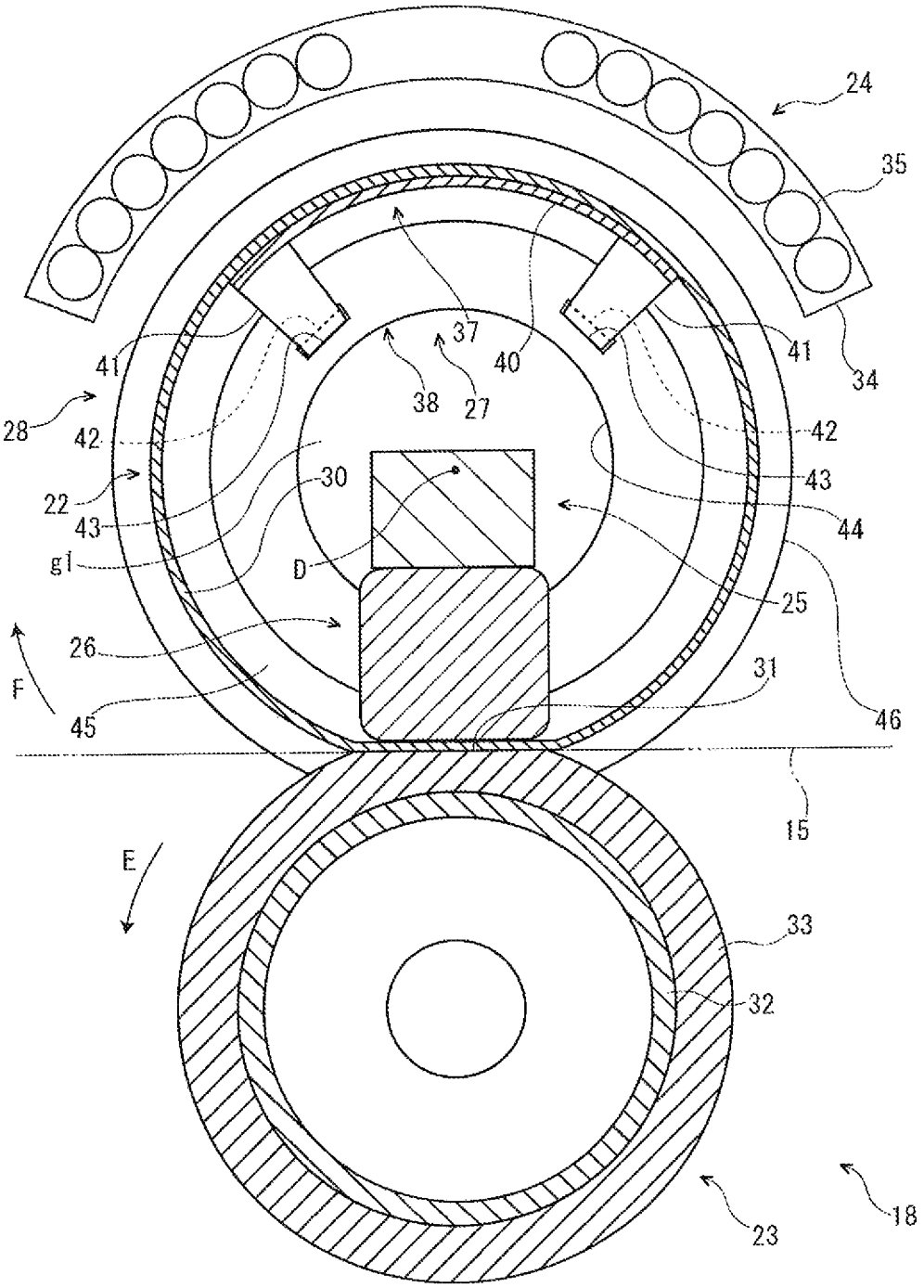
FIG. 3 is a sectional view along the line III-III of FIG. 2.

As shown in FIG. 2 and FIG. 3, the fixing device 18 includes a fixing belt 22, a pressuring roller 23 (pressuring rotator) disposed downward of the fixing belt 22, an IH fixing unit 24 disposed upward of the fixing belt 22, a holding member 25 disposed inside of the fixing belt 22, a pressing pad 26 (pressing member) disposed downward of the holding member 25, a supporting member 27 disposed upward of the holding member 25, and end caps 28 respectively disposed at both end sides in the forward or backward direction of the fixing belt 22.

First, the fixing belt 22 will be described. The fixing belt 22 is an endless thin belt having flexibility, and forms an elongated cylindrical shape in the forward or backward direction. The fixing belt 22 is rotatable around a rotation axis D extending in the forward or backward direction. Namely, in the embodiment, the forward or backward direction is a direction of the rotation axis of the fixing belt 22.

The fixing belt 22 is composed of a substrate layer 30 and a release layer (not shown) covering the substrate layer 30, for example. The substrate layer 30 of the fixing belt 22 is made of a metal such as nickel or stainless or a resin such as PI (Polyimide), for example. The release layer of the fixing belt 22 is made of a fluorine-based resin such as PFA, for example. The fixing belt 22 may include an elastic layer between the substrate layer 30 and the release layer. This elastic layer is made of a silicone rubber, for example.

Next, the pressuring roller 23 will be described. The pressuring roller 23 forms an elongated cylindrical shape in the forward or backward direction. The pressuring roller 23 comes into pressure contact with the fixing belt 22, and a fixing nip 31 is formed between the fixing belt 22 and the pressuring roller 23. When a sheet passes through the fixing nip 31, the sheet and the toner image are heated and pressured, and the toner image is fixed to the sheet.

The pressuring roller 23 is rotatably supported by a fixing frame (not shown). The pressuring roller 23 is connected to a drive source (not shown), and when the pressuring roller 23 is rotated by the drive source, the fixing belt 22 rotates in the opposite direction to the pressuring roller 23 accompanying with the rotation of the pressuring roller 23. The pressuring roller 23 is configured to convey the sheet to a downstream side of the conveying path 15 in cooperation with the fixing belt 22.

The pressuring roller 23 is composed of a cylindrical cored bar 32, an elastic layer 33 provided around the cored bar 32, and a release layer (not shown) covering the elastic layer 33, for example. The cored bar 32 of the pressuring roller 23 is made of a metal such as stainless or aluminum, for example. The elastic layer 33 of the pressuring roller 23 is made of a silicone rubber or a silicone sponge, for example. The release layer of the pressuring roller 23 is made of a fluorine-based resin such as PFA, for example.

Next, the IH fixing unit 24 will be described. The IH fixing unit 24 includes a casing member 34 and an IH coil 35 (heat source) housed in the casing member 34. The IH coil 35 is disposed outside of the fixing belt 22, and is provided in an arc shape along an outer circumference of the fixing belt 22. The IH coil 35 is configured to generate a magnetic field when a high-frequency current is fed to the IH coil 35.

Next, the holding member 25 will be described. The holding member 25 extends in the forward or backward direction, and has a rectangular sectional shape. The holding member 25 passes through a substantial center in a vertical direction of the fixing belt 22 (precisely, slightly lower than the center in the vertical direction of the fixing belt 22). Both end parts in the forward or backward direction of the holding member 25 are fixed to locking members 36 (refer to FIG. 2) respectively disposed forward and backward of the fixing belt 22. The locking member 36 is fixed to a fixing frame (not shown) or forms a part of the fixing frame, for example.

Next, the pressing pad 26 will be described. The pressing pad 26 extends in a forward or backward direction, and has a substantially rectangular sectional shape. The pressing pad 26 is housed in a lower end part of the fixing belt 22. A top face of the pressing pad 26 is fixed to a bottom face of the holding member 25. In this manner, the pressing pad 26 is held by the holding member 25. A lower end part of the pressing pad 26 comes into contact with an inner circumferential face of the fixing belt 22, and presses the fixing belt 22 from inside toward the pressuring roller 23. As the fixing belt 22 rotates, the fixing belt 22 slides with respect to the pressing pad 26. The pressing pad 26 comes into contact with only a lower part (a part of the fixing nip 31 side) of an inner circumferential face of the fixing belt 22.

Next, the supporting member 27 will be described. The supporting member 27 includes a belt supporting part 37 and cap supporting parts 38 disposed on both end sides in the forward or backward direction of the belt supporting part 37.

The belt supporting part 37 is housed in an upper end part of the fixing belt 22. The belt supporting part 37 is formed by bending a thin plate, for example. The belt supporting part 37 is made of a material developing heat by a magnetic field generated by the IH coil 35, for example, a magnetic shunt metal such as Fe—Ni alloy. The belt supporting part 37 is not fixed to the holding member 25, and is movable with respect to the holding member 25.

The belt supporting part 37 includes, a supporting piece 40 extending in a forward or backward direction, connecting pieces 41 bent from both end parts of the supporting piece 40 toward inside in a radial direction (rotation axis D side), and fitting pieces 42 bent from an end part inside in a radial direction of the connecting piece 41 toward outside in the forward or backward direction. The supporting piece 40 forms a thin-plate shape, and curves upward in an arc shape. The supporting piece 40 faces the IH coil 35 across the fixing belt 22. The supporting piece 40 supports the fixing belt 22 from inside. The connecting pieces 41 and the fitting pieces 42 form a thin plate shape, and are formed on the left and right in a pair.

Each cap supporting part 38 forms a cylindrical shape. An end part inside in the forward or backward direction of each cap supporting part 38 is inserted into the fixing belt 22, and another end part outside in the forward or backward direction of each cap supporting part 38 protrudes from the fixing belt 22. On a face inside in the forward or backward direction of each cap supporting part 38, a pair of left and right fitting holes 43 are provided, and each fitting piece 42 of the belt supporting part 37 fits into each fitting hole 43. In this manner, the cap supporting part 38 is fixed to both end parts in the forward or backward direction of the belt supporting part 37.

In each cap supporting part 38, a circular through hole 44 is formed along the forward or backward direction, and the holding member 25 passes through the through hole 44. A gap g1 is formed between an outer circumferential face of the holding member 25 and the through hole 44.

Next, the end caps 28 will be described. Each end cap 28 forms a cylindrical shape, and is rotatably attached to the outer circumference of each cap supporting part 38 of the supporting member 27. In this manner, each end cap 28 is rotatably supported by each cap supporting part 38. Each end cap 28 includes a fixed part 45 and an engagingly locking part 46 provided outside in the forward or backward direction of the fixed part 45. Since an outer diameter of the fixed part 45 is smaller than an outer diameter of the engagingly locking part 46, a boundary part between the fixed part 45 and the engagingly locking part 46 forms a stepped shape. An outer circumferential face of the fixed part 45 is fixed to each end part in the forward or backward direction of an inner circumferential face of the fixing belt 22. In this manner, each end cap 28 is mounted to each end part in the forward or backward direction of the fixing belt 22. The fixed part 45 corrects each end part in the forward or backward direction (opening part) of the fixing belt 22 in a circular shape. The engagingly locking part 46 engagingly locks each end part in the forward or backward direction of the fixing belt 22.

In the constituent elements as described above, when the toner image is fixed to a sheet, the pressuring roller 23 is rotated by a drive source (not shown) (refer to an arrow E of FIG. 3). When the pressuring roller 23 is thus rotated, the fixing belt 22 brought into pressure contact with the pressuring roller 23 rotates in an opposite direction to the pressuring roller 23 (refer to an arrow F of FIG. 3). Accompanying with this, each end cap 28 mounted to each end part in the forward or backward direction of the fixing belt 22 rotates together with the fixing belt 22. Even if the pressuring roller 23, the fixing belt 22, and each end cap 28 rotate, the IH fixing unit 24, the holding member 25, the pressing pad 26, and the supporting member 27 hold an inactive state.

When the toner image is fixed to the sheet, a high-frequency current is fed to the IH coil 35. Accompanying with this, the IH coil 35 generates a magnetic field, and by way of action of this magnetic field, an eddy current is generated at the fixing belt 22, and then, the fixing belt 22 develops heat. Further, the belt supporting part 37 of the supporting member 27 develop heat by the magnetic field generated by the IH coil 35, and by the belt supporting part 37, the fixing belt 22 is heated. In this state, when the sheet passes through the fixing nip 31, the sheet and the toner image are heated and pressured, and then, the toner image is fixed to the sheet.

In the embodiment, as described above, the end caps 28 are rotatably supported by the cap supporting parts 38 of the supporting member 27. Thus, a position of a rotational center of the end cap 28 is determined by the supporting member 27, it is possible to prevent a displacement in a relative positional relationship between the end cap 28 and the supporting member 27. Accompanying with this, it is possible to prevent displacement of a relative positional relationship between the fixing belt 22 and the supporting member 27, and it is possible to avoid occurrence of steps in the fixing belt 22 in a peripheral region of both end parts of the belt supporting part 37 (refer to a portion G of FIG. 2). Thus, in the peripheral region of both end parts of the belt supporting part 37, it is possible to prevent a shear stress from concentrating on the fixing belt 22 and the durability of fixing belt 22 can be improved.

Each end part in the forward or backward direction of the fixing belt 22 is corrected in a circular shape by the fixed part 45 of each end cap 28, and each end cap 28 rotates together with the fixing belt 22. Thus, it is possible to prevent an occurrence of crack or breakage at both end parts in the forward or backward direction of the fixing belt 22 due to a friction with the end cap 28, and in this respect also, the durability of the fixing belt 22 can be improved.

Further, since the fixing belt 22 is supported from inside by the belt supporting part 37 of the supporting member 27, it is possible to normalize (uniform) a distance between the IH coil 35 and the fixing belt 22 all over the areas in the forward or backward direction. Accompanying with this, the heating performance of the fixing belt 22 can be improved.

Also, the supporting member 27 is composed of the belt supporting part 37 supporting the fixing belt 22 from inside and the cap supporting parts 38 fixed to both end parts in the forward or backward direction of the belt supporting part 37 and rotatably supporting the end cap 28. Thus, both of the fixing belt 22 and the end cap 28 can be reliably supported by the supporting member 27.

In addition, the holding member 25 passes through the through hole 44 provided in each cap supporting part 38. Thus, the holding member 25 can be fixed to a locking member 36 provided outside in the forward or backward direction of the cap supporting part 38 and a fixing strength of the holding member 25 can be increased. Accompanying with this, the pressing pad 26 can be reliably held by the holding member 25.

Further, since the IH coil 35 is used as the heat source, it is possible to improve efficiency and velocity of heating the fixing belt 22 in comparison with a case of using a halogen heater or the like as a heat source. Furthermore, since the belt supporting part 37 of the supporting member 27 is made of a material developing heat by the magnetic field generated by the IH coil 35, it is possible to heat the fixing belt 22 by the belt supporting part 37, and it is possible to further improve the efficiency and velocity of heating the fixing belt 22.

In the embodiment, the gap g1 is formed between the through hole 44 of each cap supporting part 38 and the outer circumferential face of the holding member 25. On the other hand, in another embodiment, an elastic member may be interposed between the through hole 44 of each cap supporting part 38 and the outer circumferential face of the holding member 25. This elastic member can be made of a silicone sponge or rubber, for example.

In the embodiment, drive is inputted from the drive source (not shown) to only the pressuring roller 23. On the other hand, in another embodiment, drive may be inputted from the drive source to only the end cap 28, drive may be inputted from the drive source to both of the pressuring roller 23 and the end cap 28, and when drive is inputted to the end cap 28, for example, a gear is provided on the outer circumferential face of an engagingly locking part 46 of the end cap 28, and the gear may be connected to the drive source.

In the embodiment, belt supporting part 37 and the cap supporting part 38 of the supporting member 27 are separately formed. On the other hand, in another embodiment, the belt supporting part 37 and the cap supporting part 38 of the supporting member 27 may be integrally formed.

In the embodiment, the IH coil 35 is used as a heat source. On the other hand, in another embodiment, a heater such as a halogen heater or a ceramics heater may be used as a heat source.

In the embodiment, the configuration of the disclosure is applied to the printer 1. On the other hand, in another embodiment, the configuration of the disclosure may be applied to a copying machine, a facsimile, a multifunction peripheral or the like.

Second Embodiment

Next, a fixing device 51 according to a second embodiment of the present disclosure will be described with reference to FIG. 4 and FIG. 5. An arrow I of FIG. 4 indicates inside in the forward or backward direction, and an arrow O of FIG. 4 indicates outside in the forward or backward direction. Since constituent elements other than a supporting member 52 are similar to those of the first embodiment, these constituent elements in the figures are designated by the same reference numerals as those of the first embodiment, and a duplicate description thereof is omitted.

The supporting member 52 includes a belt supporting part 53, cap supporting parts 54 disposed on both end sides in a forward or backward direction of the belt supporting part 53, and deviation-preventing parts 55 disposed outside in the forward or backward direction of the cap supporting parts 54.

A configuration of the belt supporting part 53 is similar to a configuration of the belt supporting part 37 of the first embodiment. Thus, the constituent elements of the belt supporting part 53 are designated by the same reference numerals as those of the constituent elements of the belt supporting part 37 of the first embodiment, and a duplicate description thereof is omitted. A configuration of the cap supporting parts 54 is similar to a configuration of the cap supporting parts 38 of the first embodiment except that an end part outside in the forward or backward direction of each cap supporting part 54 is more protrusive to the outside of the forward or backward direction than the end cap 28. Thus, the constituent elements of the cap supporting parts 54 are designated by the same reference numerals as those of the constituent elements of the cap supporting parts 38 of the first embodiment, and a duplicate description thereof is omitted.

Each deviation-preventing part 55 forms a circular ring shape. An inner circumferential part of a face inside in the forward or backward direction of each deviation-preventing part 55 is fixed to a face outside in the forward or backward direction of each cap supporting part 54. In each deviation-preventing part 55, a communication hole 56 is formed along the forward or backward direction. The communication hole 56 communicates with the through hole 44 of each cap supporting part 54. The holding member 25 passes through the communication hole 56. A gap g2 is formed between the communication hole 56 and the outer circumferential face of the holding member 25.

The outer circumferential part of each deviation-preventing part 55 is disposed outside in the forward or backward direction of each end cap 28. A circular projection 57 is provided at an outer circumferential part of the face inside in the forward or backward direction of each deviation-preventing part 55.

Figure 4:
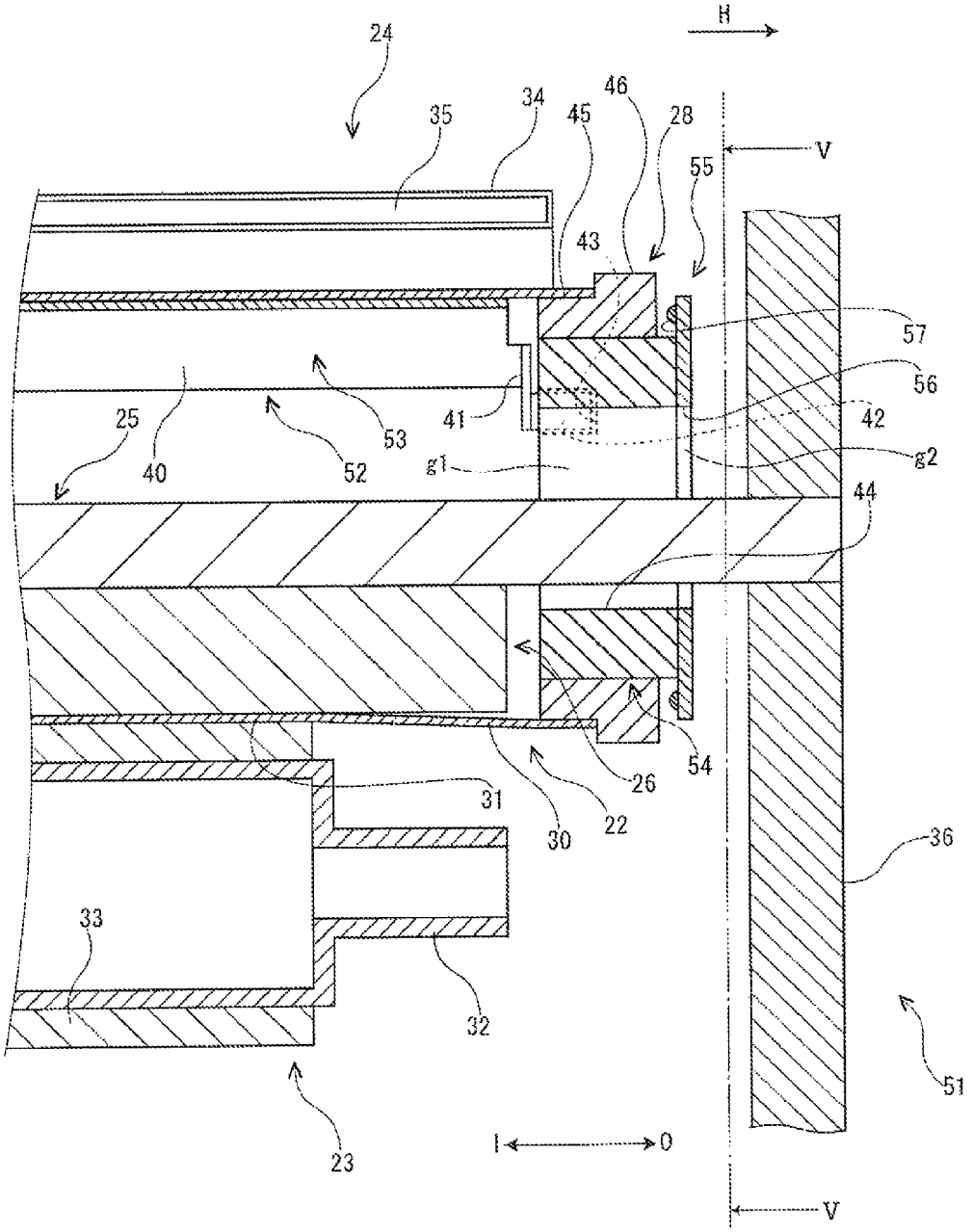
FIG. 4 is a sectional side view showing a fixing device in a printer according to a second embodiment of the present disclosure.
Figure 5:
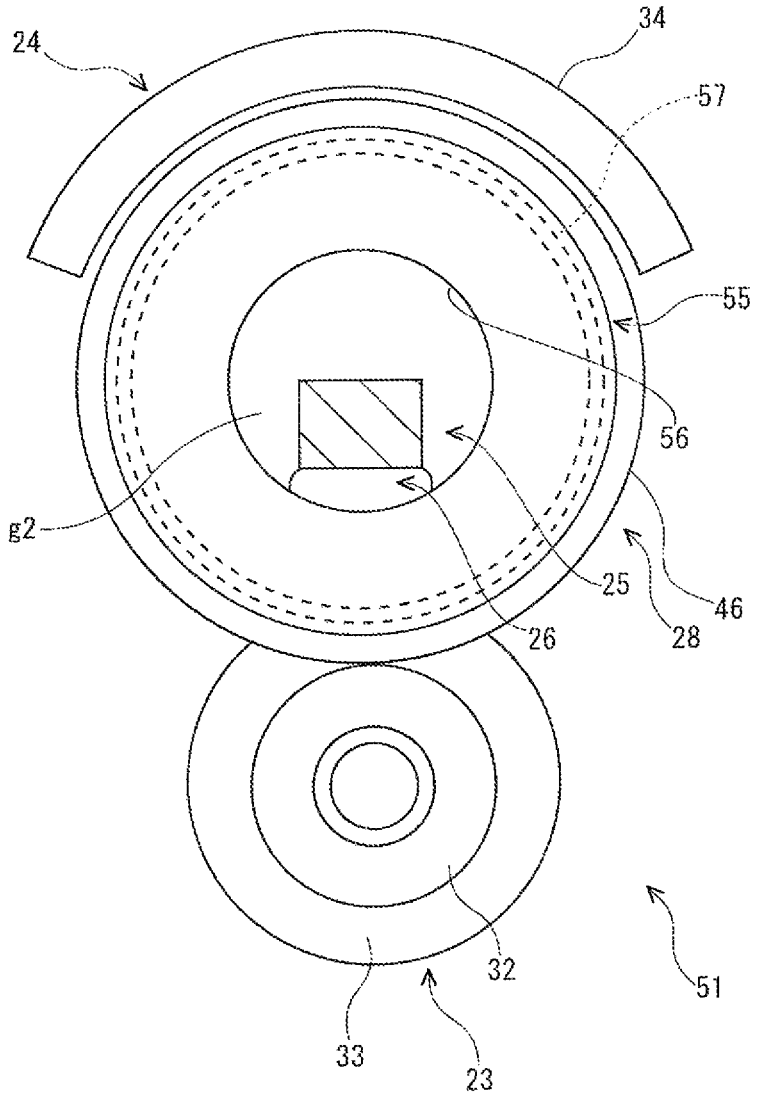
FIG. 5 is a sectional view along the line V-V of FIG. 4.

In the constituent elements as described above, when the fixing belt 22 rotates, the fixing belt 22 deviates to outside in the forward or backward direction (refer to an arrow H of FIG. 4). When the fixing belt 22 thus deviates to the outside in the forward or backward direction, the end cap 28 comes into contact with the projection 57 of the deviation-preventing part 55. In this manner, it is possible to reliably prevent the fixing belt 22 from deviates to the outside in the forward or backward direction by a predetermined margin or more.

Third Embodiment

Figure 6:
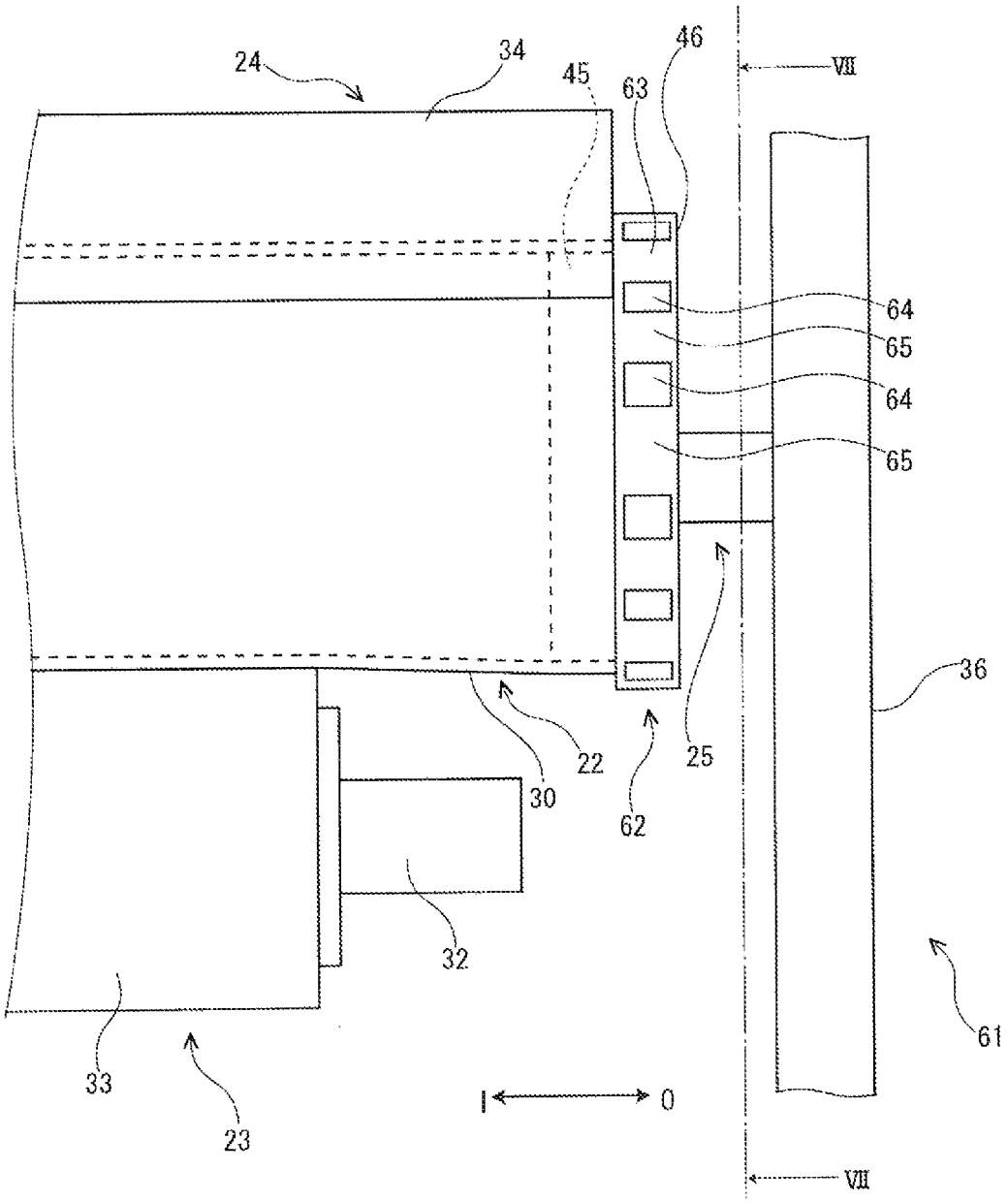
FIG. 6 is a side view showing a fixing device in a printer according to a third embodiment of the present disclosure.
Figure 7:
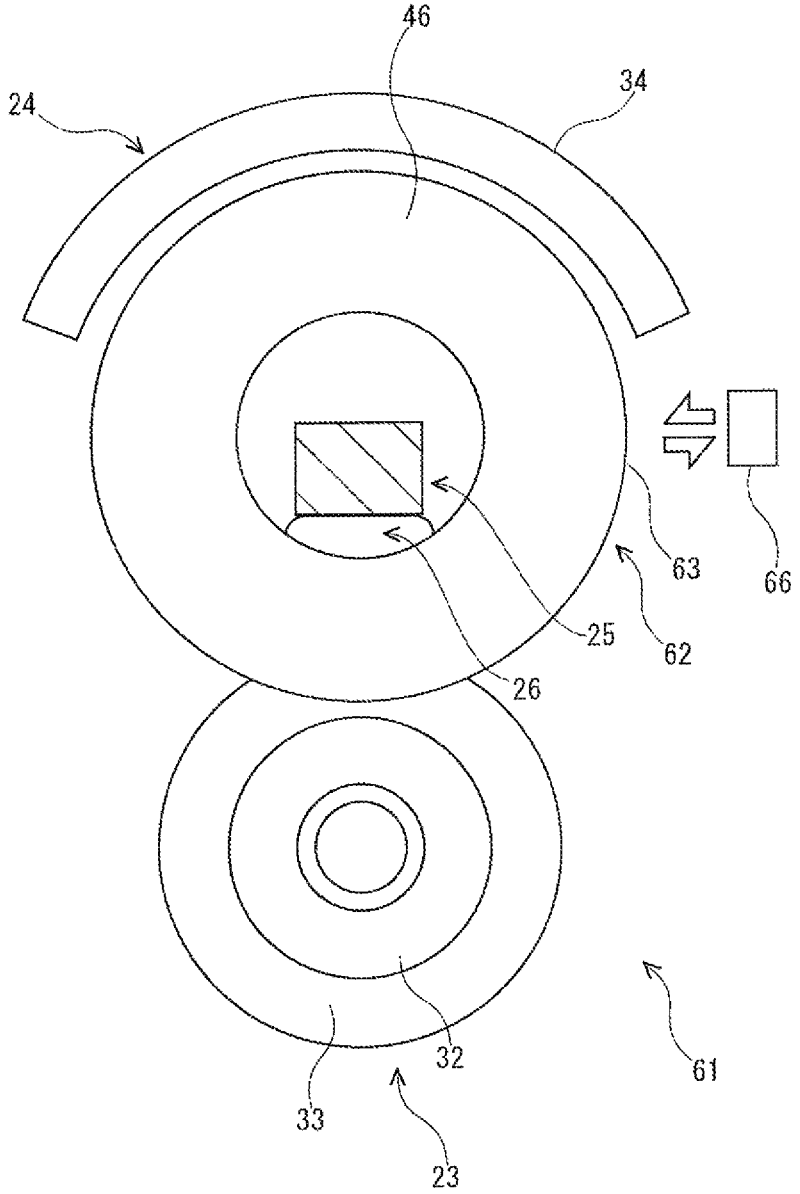
FIG. 7 is a sectional view along the line VII-VII of FIG. 6.
Figure 8A:
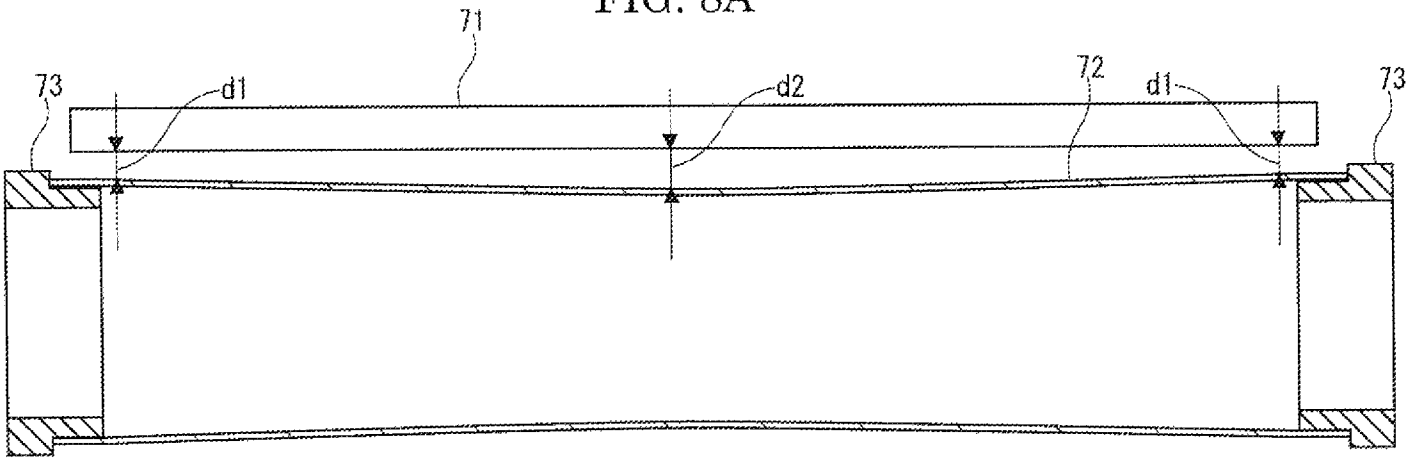
FIG. 8A and FIG. 8B are sectional side views showing a fixing device.
Figure 8B:
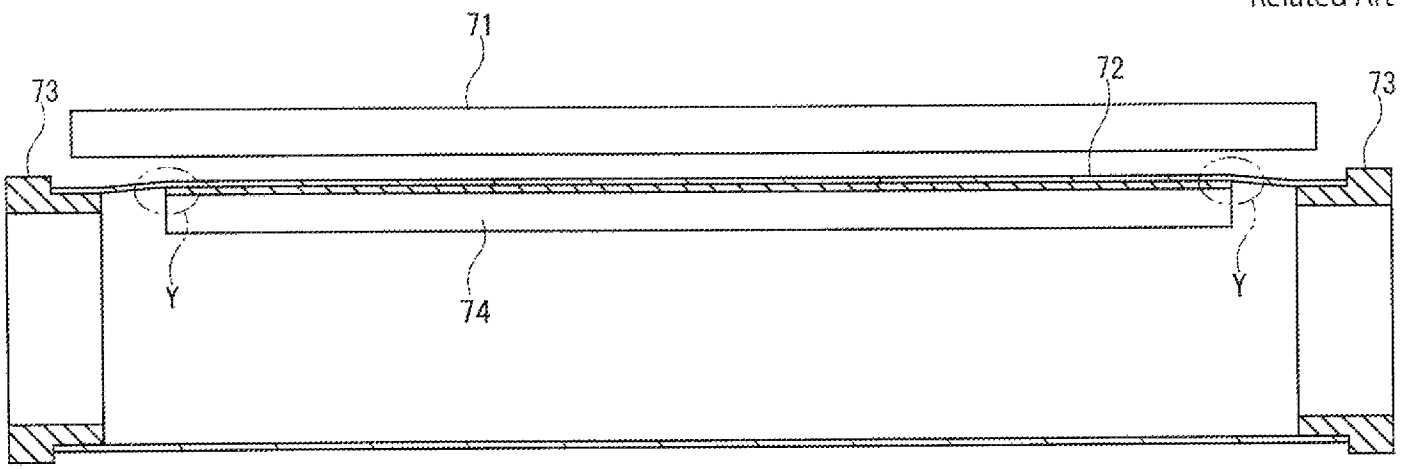
FIG. 8B Related Art

Next, a fixing device 61 according to a third embodiment of the present disclosure will be described with reference to FIG. 6 and FIG. 7. An arrow I of FIG. 6 indicates inside in a forward or backward direction, and an arrow O of FIG. 6 indicates outside in the forward or backward direction. Since constituent elements other than the end cap 62 are similar to those of the first embodiment, these constituent elements are designated by the same reference numerals as those of the first embodiment, and a duplicate description thereof is omitted. As to the end cap 62, the similar constituent elements to those of the first embodiment are designated in the figures by the same reference numerals as those of the end cap 28 of the first embodiment, and a duplicate description thereof is omitted.

A detected part 63 is provided on an outer circumferential face of an engagingly locking part 46 of the end cap 62. In the detected part 63, an applied part 64 to which coating is applied and a non-applied part 65 to which no coating is applied, are alternately provided in a circumferential direction.

A sensor 66 is disposed lateral of the engagingly locking part 46 of the end cap 62. The sensor 66 is a reflective PI sensor (Photo Interrupter Sensor), for example. The sensor 66 includes a light emitting part configured to emit light toward the detected part 63 and a light receiving part configured to receive light reflected from the detected part 63.

In the constituent elements as mentioned above, in a state in which the detected part 63 is not rotating, namely in a state in which the fixing belt 22 and the end cap 62 are not rotating, the light emitted from the light emitting part of the sensor 66 continuously hits either the applied part 64 or the non-applied part 65 of the detected part 63. Thus, the light reception amount of the light receiving part of the sensor 66 is kept constant. In this case, it is possible to determine that the fixing belt 22 is not rotating.

On the other hand, in a state in which the detected part 63 is rotating, namely in a state in which the fixing belt 22 and the end cap 62 are rotating, since the light emitted from the light emitting part of the sensor 66 alternately hits the applied part 64 and the non-applied part 65 of the detected part 63, the light reception amount of the light receiving part of the sensor 66 switches. In this case, it is possible to determine that the fixing belt 22 is rotating.

As described above, in the embodiment, rotation of the detected part 63 of the end cap 62 can be detected by the sensor 66. Thus, it is possible to determine whether or not the fixing belt 22 is rotating, based on a result of detection of the sensor 66, and it is possible to avoid a circumstance that the fixing belt 22 is heated by the IH coil 35 in the state in which the fixing belt 22 is not rotating.

While the present disclosure has been described with reference to the particular illustrative embodiments, it is not to be restricted by the embodiments. It is to be appreciated that those skilled in the art can change or modify the embodiments without departing from the scope and spirit of the present disclosure.

What is claimed is:

1. A fixing device comprising:

a fixing belt rotatably provided;

a pressuring rotator rotatably provided and coming into pressure contact with the fixing belt to form a fixing nip between the fixing belt and the pressuring rotator;

a pressing member configured to press the fixing belt from inside toward the pressuring rotator;

a heat source disposed outside of the fixing belt and configured to heat the fixing belt;

a supporting member facing the heat source across the fixing belt and configured to support the fixing belt from inside;

an end cap mounted to an end part in a direction of a rotation axis of the fixing belt and rotatably supported by the supporting member; and a holding member extending in the direction of the rotation axis and configured to hold the pressing member, wherein the supporting member includes:

a belt supporting part configured to support the fixing belt from inside; and a cap supporting part fixed to an end part in the direction of the rotation axis of the belt supporting part and configured to rotatably support the end cap, wherein the cap supporting part includes a through hole formed along the direction of the rotation axis and the holding member passes through the through hole.

2. The fixing device according to claim 1, wherein the supporting member includes a deviation-preventing part disposed outside in the direction of the rotation axis of the end cap.

3. The fixing device according to claim 2, wherein a circular projection is provided on a face inside in the direction of the rotation axis of the deviation-preventing part.

4. The fixing device according to claim 1, further comprising:

a detected part provided on an outer circumferential face of the end cap; and a sensor configured to detect rotation of the detected part.

5. The fixing device according to claim 1, wherein the heat source is an IH coil configured to generate a magnetic field to heat the fixing belt.

6. The fixing device according to claim 5, wherein at least a part of the supporting member is made of a material developing heat by a magnetic field generated by the IH coil.

7. A fixing device comprising:

a fixing belt rotatably provided;

a pressuring rotator rotatably provided and coming into pressure contact with the fixing belt to form a fixing nip between the fixing belt and the pressuring rotator;

a pressing member configured to press the fixing belt from inside toward the pressuring rotator;

a heat source disposed outside of the fixing belt and configured to heat the fixing belt;

a supporting member facing the heat source across the fixing belt and configured to support the fixing belt from inside; and an end cap mounted to an end part in a direction of a rotation axis of the fixing belt and rotatably supported by the supporting member, wherein the supporting member includes:

a belt supporting part configured to support the fixing belt from inside; and a cap supporting part fixed to an end part in the direction of the rotation axis of the belt supporting part and configured to rotatably support the end cap, wherein the belt supporting part includes:

a supporting piece extending in the direction of the rotation axis and configured to support the fixing belt from inside;

a connecting piece bent from an end part in the direction of the rotation axis of the supporting piece toward inside in a radial direction; and a fitting piece bent from an end part inside in the radial direction of the connecting piece toward outside in the direction of the rotation axis, wherein a fitting hole into which the fitting piece fits is provided on a face inside in the direction of the rotation axis of the cap supporting part.

8. The fixing device according to claim 7, wherein the fitting pieces and the fitting holes are provided in a pair.

9. An image forming apparatus comprising a fixing device configured to include:

a fixing belt rotatably provided;

a pressuring rotator rotatably provided and coming into pressure contact with the fixing belt to form a fixing nip between the fixing belt and the pressuring rotator;

a pressing member configured to press the fixing belt from inside toward the pressuring rotator;

a heat source disposed outside of the fixing belt and configured to heat the fixing belt;

a supporting member facing the heat source across the fixing belt and configured to support the fixing belt from inside;

an end cap mounted to an end part in a direction of a rotation axis of the fixing belt and rotatably supported by the supporting member; and a holding member extending in the direction of the rotation axis and configured to hold the pressing member, wherein the supporting member includes:

a belt supporting part configured to support the fixing belt from inside; and a cap supporting part fixed to an end part in the direction of the rotation axis of the belt supporting part and configured to rotatably support the end cap, wherein the cap supporting part includes a through hole formed along the direction of the rotation axis and the holding member passes through the through hole.

10. The image forming apparatus according to claim 9, wherein the belt supporting part includes:

a supporting piece extending in the direction of the rotation axis and configured to support the fixing belt from inside;

a connecting piece bent from an end part in the direction of the rotation axis of the supporting piece toward inside in a radial direction; and a fitting piece bent from an end part inside in the radial direction of the connecting piece toward outside in the direction of the rotation axis, wherein a fitting hole into which the fitting piece fits is provided on a face inside in the direction of the rotation axis of the cap supporting part.

11. The image forming apparatus according to claim 10, wherein the fitting pieces and the fitting holes are provided in a pair.

12. The image forming apparatus according to claim 9, wherein the supporting member includes a deviation-preventing part disposed outside in the direction of the rotation axis of the end cap.

13. The image forming apparatus according to claim 12, wherein a circular projection is provided on a face inside in the direction of the rotation axis of the deviation-preventing part.

14. The image forming apparatus according to claim 9, wherein the fixing device further includes:

a detected part provided on an outer circumferential face of the end cap; and a sensor configured to detect rotation of the detected part.

15. The image forming apparatus according to claim 9, wherein the heat source is an IH coil configured to generate a magnetic field to heat the fixing belt.

16. The image forming apparatus according to claim 15, wherein at least a part of the supporting member is made of a material developing heat by a magnetic field generated by the IH coil.

* * * * *